US006857538B2

(12) United States Patent
Lin

(10) Patent No.: US 6,857,538 B2
(45) Date of Patent: Feb. 22, 2005

(54) GARBAGE BIN WITH COVER

(76) Inventor: Tsong-Yow Lin, No. 57-1,Yung Ho Street, Ta Tu Hsiang, Taichung Hsien (TW)

( * ) Notice: Subject to any disclaimer, the term of this patent is extended or adjusted under 35 U.S.C. 154(b) by 13 days.

(21) Appl. No.: 10/131,927

(22) Filed: Apr. 25, 2002

(65) Prior Publication Data

US 2003/0201265 A1 Oct. 30, 2003

(51) Int. Cl.[7] ..... B65D 43/14
(52) U.S. Cl. ..... 220/830; 220/908; 220/254.3
(58) Field of Search ..... 220/908, 830, 220/831, 254.3; 16/50, 52, 54, 289, 291, 292, 307; 379/433.13

(56) References Cited

U.S. PATENT DOCUMENTS

| | | | | | |
|---|---|---|---|---|---|
| 5,142,738 | A | * | 9/1992 | Ojima | 16/306 |
| 5,211,269 | A | * | 5/1993 | Ohshima | 188/290 |
| 5,382,108 | A | * | 1/1995 | Ojima | 403/120 |
| 6,178,085 | B1 | * | 1/2001 | Leung | 361/683 |
| 6,206,281 | B1 | * | 3/2001 | Leung | 235/61 R |
| 6,336,252 | B1 | * | 1/2002 | Bando | 16/307 |
| 6,345,725 | B1 | * | 2/2002 | Lin | 220/263 |
| 6,510,588 | B2 | * | 1/2003 | Eromaki | 16/308 |
| 2003/0173369 | A1 | * | 9/2003 | Nikolaus et al. | 220/830 |

FOREIGN PATENT DOCUMENTS

| | | | | |
|---|---|---|---|---|
| JP | 2000008700 A | * | 1/2000 | E05F/5/08 |

* cited by examiner

*Primary Examiner*—Lee Young
*Assistant Examiner*—James Smalley
(74) *Attorney, Agent, or Firm*—Alan D. Kamrath; Nikolai & Mersereau, P.A.

(57) ABSTRACT

A cover assembly includes a ring mounted on a garbage bin, a cover mounted on the ring and a slow pivot device for slowly pivoting the cover relative to the ring. The slow pivot device includes a slow pivot element installed between the ring and the cover. The slow pivot element includes an internal tube, an external tube enclosing the internal tube and a spring connected between the internal tube and the external tube. Thus, rotation of the internal tube relative to the external tube exerts a torque on the spring. The spring is received in the internal tube so that an end thereof is connected with the internal tube. The internal tube is received in the internal tube so that an end thereof is connected with the internal tube. The internal tube is received in the external tube so that the other end of the spring is connected with the external tube. The internal tube includes a clip formed on an internal side thereof for clipping an end of the spring. The external tube includes a clip formed on an internal side thereof for clipping an opposite end of the spring. Damping oil is provided between the internal tube and the external tube so as to camp pivot of the internal tube relative to the external tube.

15 Claims, 8 Drawing Sheets

3 – 3

GARBAGE BIN WITH COVER

BACKGROUND OF INVENTION

1. Field of Invention

The present invention is related to a garbage bin with a cover.

2. Related Prior Art

People dispose of garbage in garbage bins. Some of the garbage stinks some time after the disposal. Therefore, some of the garbage bins are equipped with covers in order to keep the odor of such garbage therein. In some other cases, people use garbage bins equipped with covers simply to conceal garbage contained therein.

Some covers can be removed from garbage bins. However, such a cover causes a user trouble for he or she has to hold the cover during disposal of garbage or find a place to lay the cover on before disposal of garbage.

Some other covers are pivotally mounted on garbage bins. However, closing the garbage bins with the covers often makes loud noises.

In some other garbage bins equipped with covers, springs are connected between the garbage bins and the covers. For example, FIGS. 7 and 8 show a garbage bin 2 on which a cover 3 is pivotally mounted. The garbage bin 2 is formed with a female engagement element 5. The cover 3 is formed with a male engagement element 4 for engagement with the female engagement element 5 in order to lock the cover 3 to the garbage bin 2. Two springs 6 are mounted on the garbage bin 2 for biasing the cover 3. The springs 6 damp the closing of the garbage bin 2 with the cover 3, thus avoiding loud noises. However, when the male engagement element 4 is released from the female engagement element 5, the cover 3 is pivoted from the garbage bin 2 by means of the springs 6 so as to cause the garbage bin 2 to shiver and even fall.

The present invention is therefore intended to obviate or at least alleviate the problems encountered in prior art.

SUMMARY OF INVENTION

It is an objective of the present invention to provide a garbage bin with a cover that can be pivoted on the garbage bin nice and ease.

According to the present invention, a cover assembly includes a ring mounted on a garbage bin, a cover mounted on the ring and a slow pivot device for slowly pivoting the cover relative to the ring.

The slow pivot device includes at least one slow pivot element installed between the ring and the cover.

The at least one slow pivot element includes an internal tube, an external tube enclosing the internal tube and a spring connected between the internal tube and the external tube. Thus, rotation of the internal tube relative to the external tube exerts a torque on the spring.

The spring is received in the internal tube so that an end thereof is connected with the internal tube. The internal tube is received in the external tube so that the other end of the spring is connected with the external tube.

The internal tube includes a clip formed on an internal side thereof for clipping an end of the spring. The external tube includes a clip formed on an internal side thereof for clipping an opposite end of the spring.

Damping oil is provided between the internal tube and the external tube in order to damp pivot of the internal tube relative to the external tube.

The slow pivot device includes at least one holder formed on the ring for holding an end of the at least one slow pivot element and at least one holder formed on the cover for holding the other end of the at least one slow pivot element.

The at least one pivot element includes two ridges formed at two ends, respectively. The at least one holder formed on the ring defines a slit in order to receive one of the ridges. The at least one holder formed on the cover defines a slit in order to receive the remaining one of the ridges.

The cover assembly may include a sleeve formed on the cover for receiving the at least one slow pivot element. The sleeve may include two semi-sleeves engaged with each other.

The cover includes two studs projecting in opposite directions from the cover. The ring defines two apertures for receiving the studs, thus pivotally mounting the cover on the ring.

The cover assembly includes a device for locking the cover to the ring.

The ring may be merged with the garbage bin.

Other objectives, advantages, and novel features of the invention will become more apparent from the following detailed description when taken in conjunction with the attached drawings.

BRIEF DESCRIPTION OF DRAWINGS

The present invention is described through detailed illustration of embodiments referring to the attached drawings wherein.

DETAILED DESCRIPTION OF EMBODIMENTS

Figure 1:
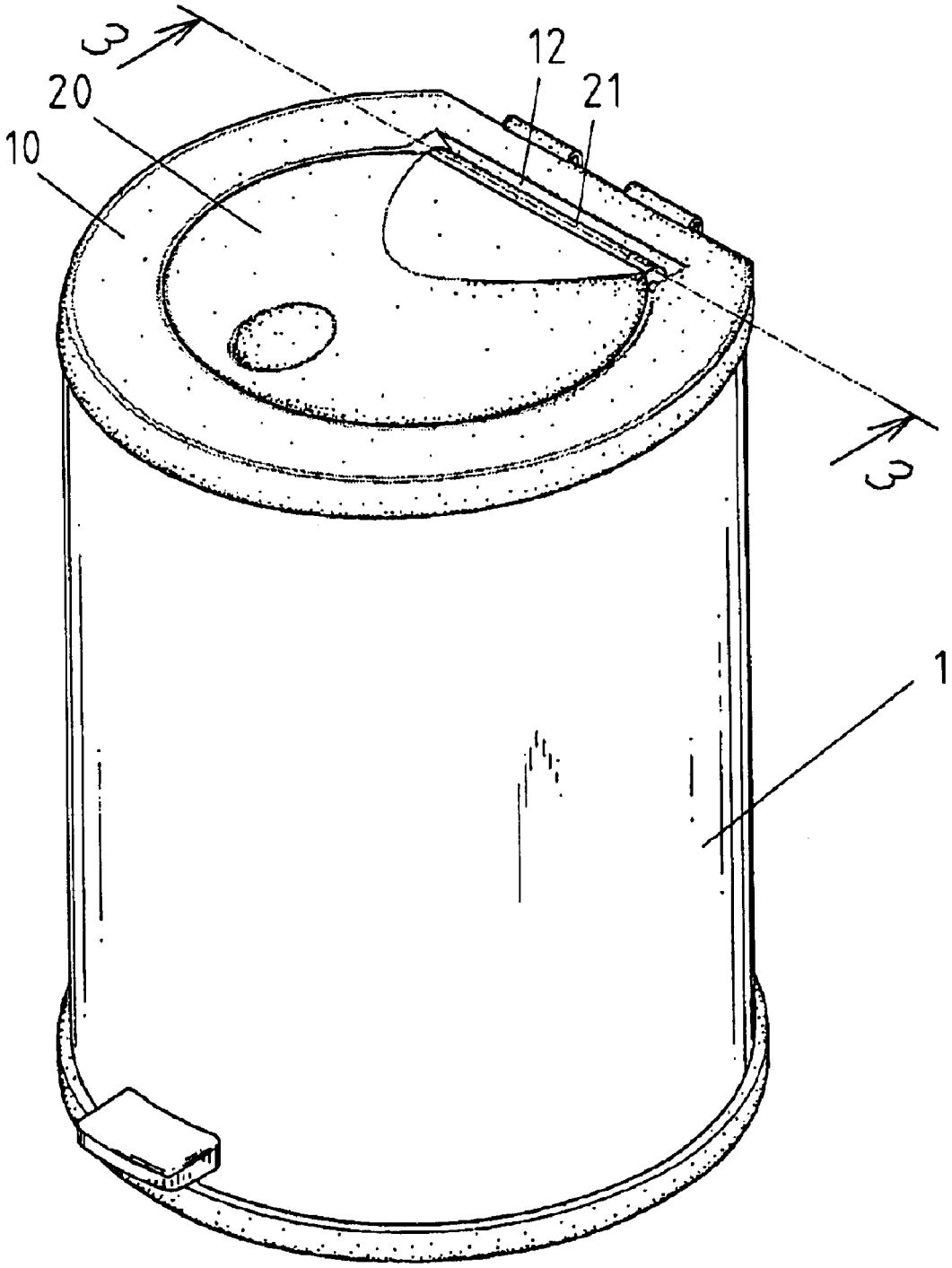
FIG. 1 is a perspective view of a garbage bin on which a cover is pivotally mounted by means of a hinge according to a first embodiment of the present invention.
Figure 2:
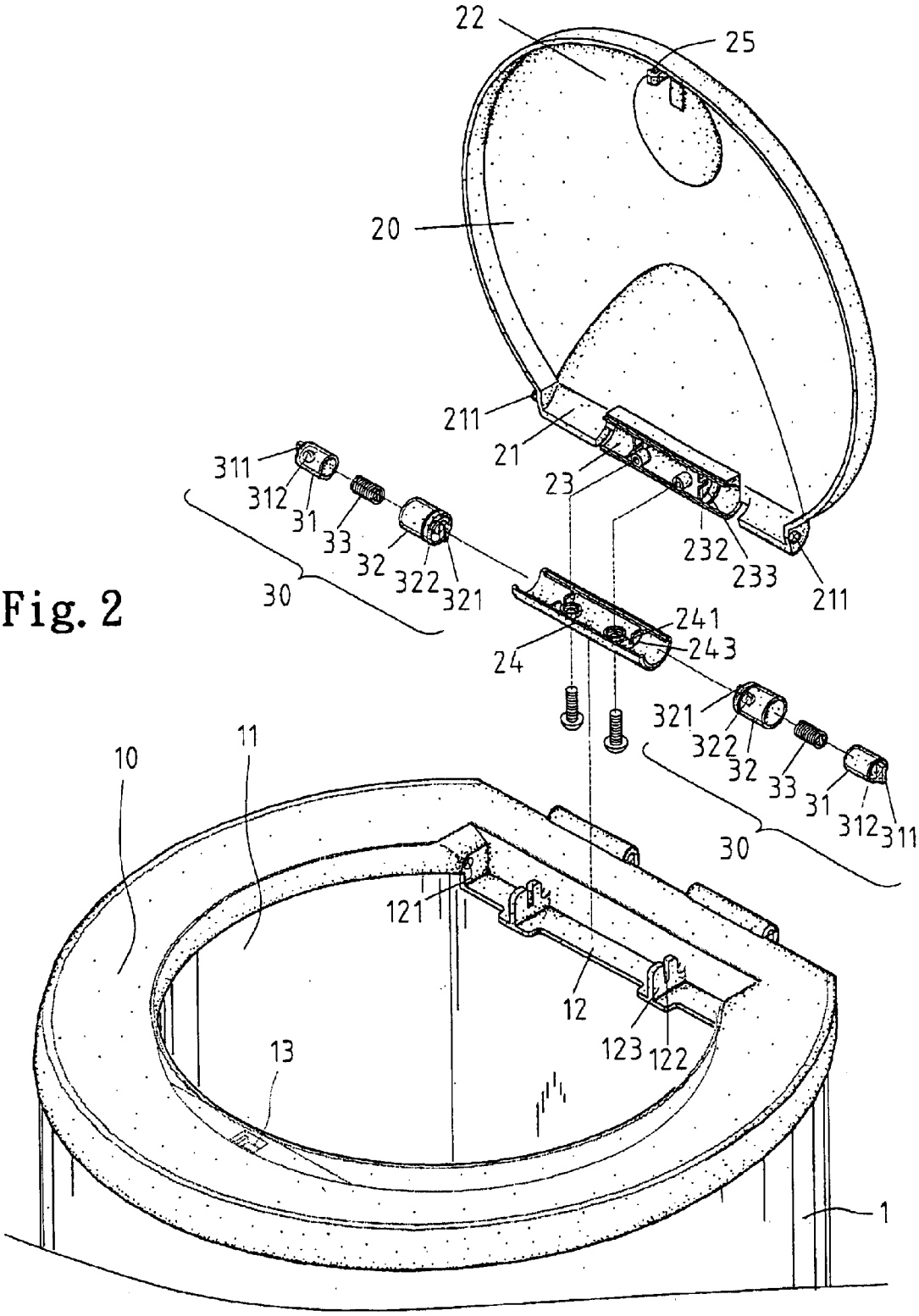
FIG. 2 is an exploded view of the hinge shown in FIG. 1.
Figure 3:
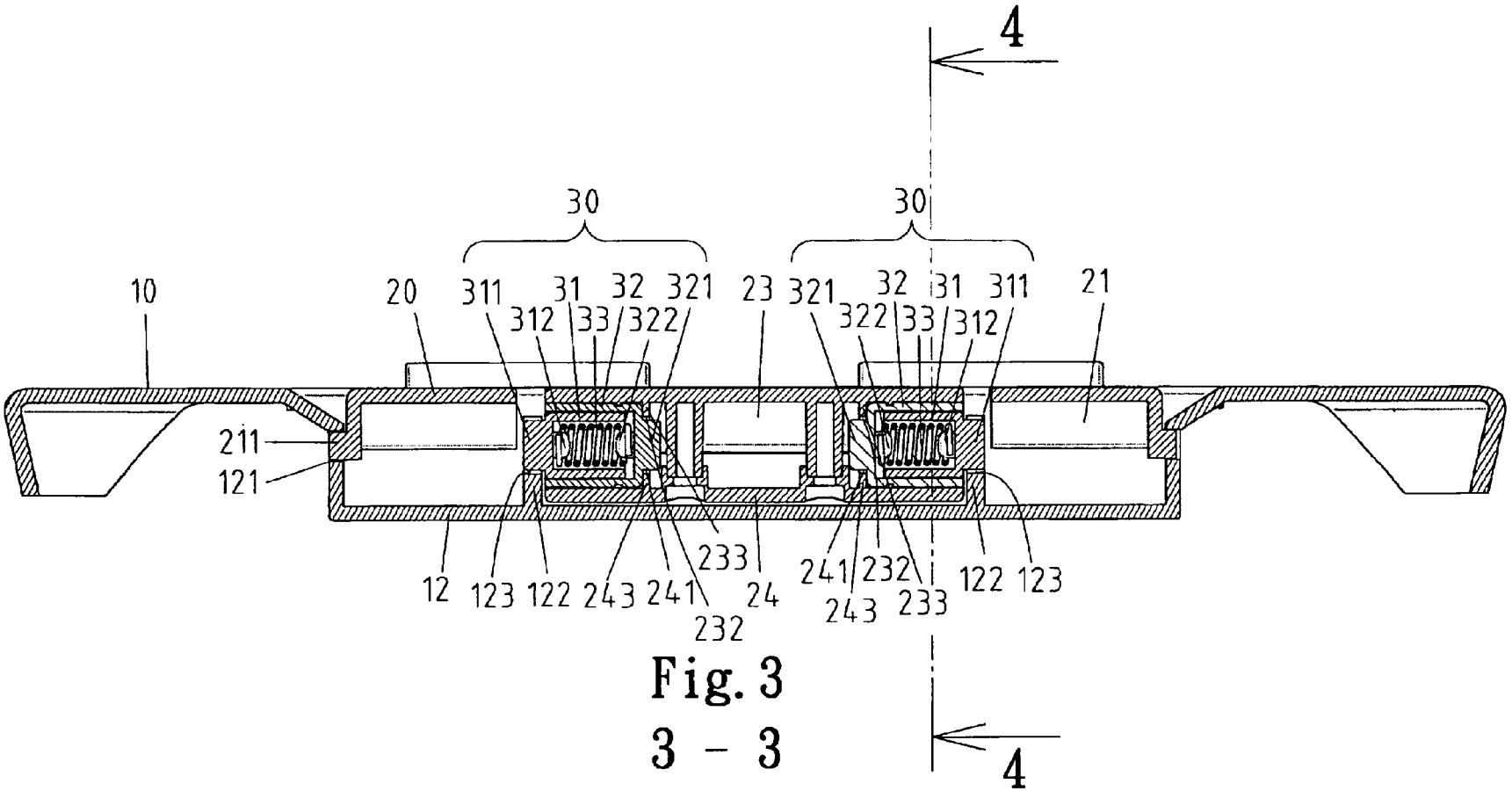
FIG. 3 is a cross-sectional view taken along a line 3—3 in FIG. 1.
Figure 4:
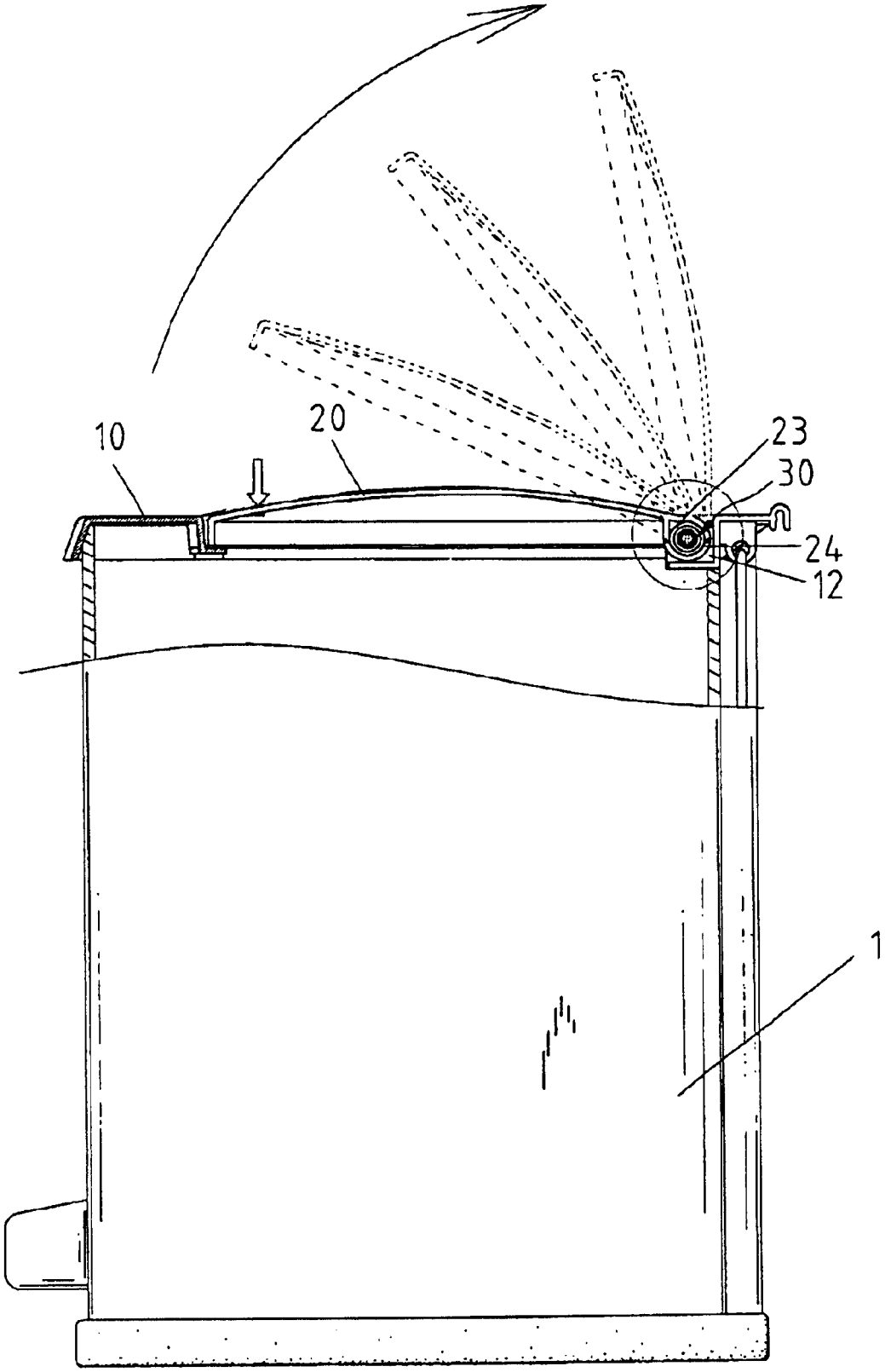
FIG. 4 is a cross-sectional view taken along a line 4—4 in FIG. 3.
Figure 5:
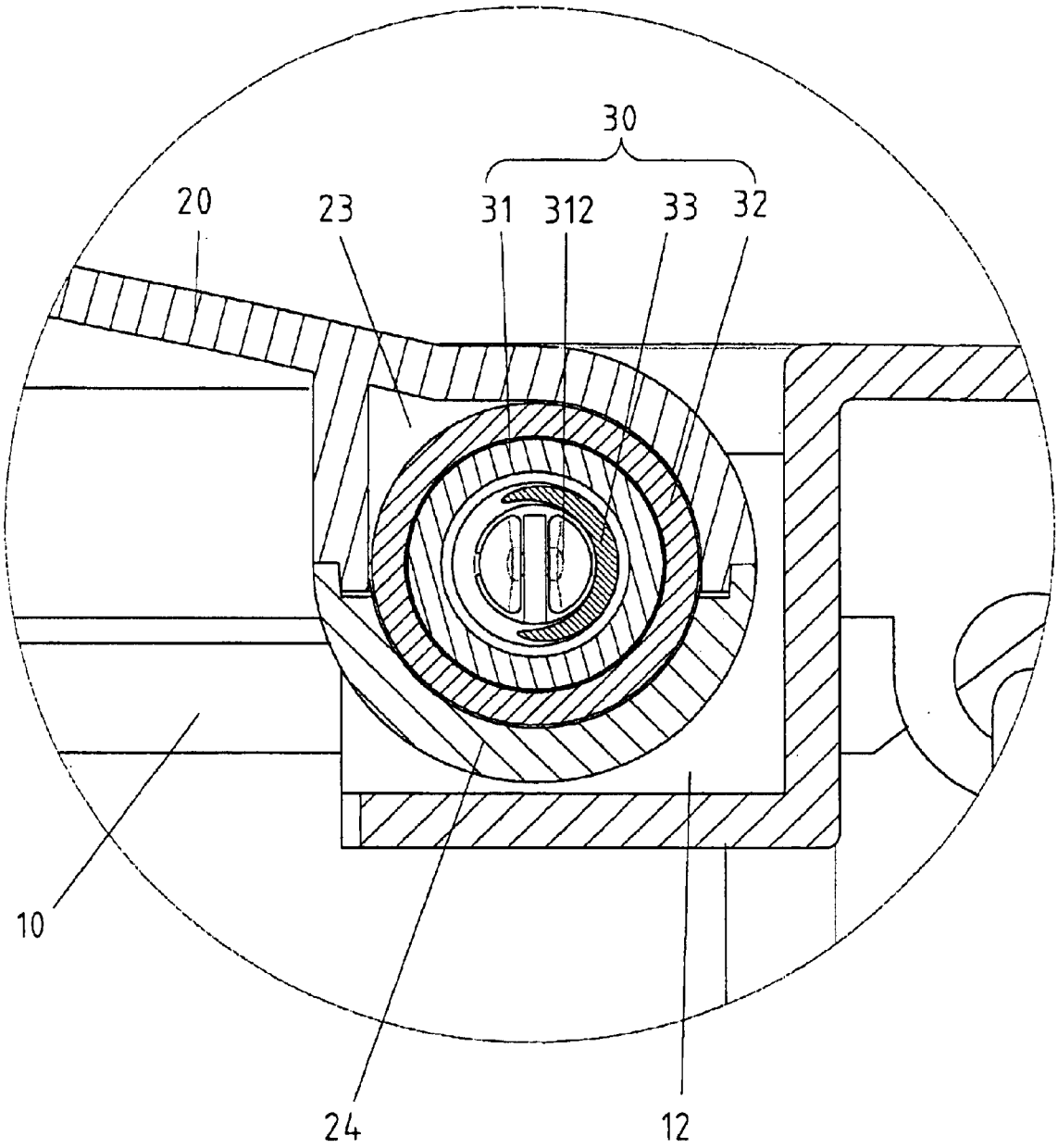
FIG. 5 shows a portion of FIG.4 in an enlarged scale.

FIGS. 1–5 show a garbage bin 1 on which a cover assembly is mounted according to a first embodiment of the present invention. The cover assembly includes a ring 10 mounted on an annular rim (not shown) of the garbage bin 1, a cover 20 mounted on the ring 10 and a slow pivot device (not numbered) for slowly pivoting the cover 20 relative to the ring 10.

The ring 10 is configured corresponding to the annular rim of the garbage bin 1. The ring 10 is mounted on the annular rim of the garbage bin 1 so that the former can be removed from the latter. Ways to mount the ring 10 on the annular rim of the garbage bin 1 are numerous and will not be described in detail for not being the spirit of the present invention.

The ring 10 defines an opening 11 through which garbage can be tossed into the garbage bin 1. The ring 10 includes a linear section (not numbered) and a base 12 projecting horizontally from the linear section. Two walls (not numbered) project vertically from the base 12. Each of the walls defines an aperture 121.

The cover 20 is configured corresponding to the opening 11 defined in the ring 10. The cover 20 includes a linear edge 21. The linear edge 21 includes two studs 211 each extending from an end thereof.

The studs 211 extending from the cover 20 can be inserted in the apertures 121 defined in the ring 10, thus pivotally mounting the cover 20 on the ring 10.

The cover assembly includes a device for locking the cover 20 to the ring 10. The locking device includes a book 25 projecting from an inside surface 22 of the cover 20 and a hole 13 defined in the ring 10 for receiving the hook 25. A lock (not shown) is installed beneath the ring 10 for releasable engagement with the hook 25. The lock will not be described in detail for being conventional and not the spirit of the present invention.

The cover assembly includes a slow pivot device for slowly pivoting the cover 20 on the ring 10. According to the first embodiment, the slow pivot device includes two slow pivot elements 30, two holders 123 formed on the ring 10 each for holding an end of one of the slow pivot elements 30 and two holders 233 formed on the cover 20 each for holding the other end of one of the slow pivot elements 30. However, according to another embodiment, the slow pivot device may include only one slow pivot element 30, only one holder 123 and only one holder 233.

Each slow pivot element 30 includes an internal tube 31, an external tube 32 and a spring 33. The internal tube 31 includes an open end and a closed end. A ridge 311 is formed on an external side of the closed end of the internal tube 31. A clip 312 is formed on an internal side of the closed end of the internal tube 31. Similarly, the external tube 32 includes an open end, a closed end, a ridge 321 and a clip 322.

The spring 33 is received in the internal tube 31 so that an end thereof is clipped by means of the clip 312. The internal tube 31 is received in the external tube 32 so that the other end of the spring 33 is clipped by means of the clip 322. Thus, rotation of the internal tube 31 relative to the external tube 32 exerts on the spring 33 a torque that tends to turn the internal tube 31 back to the original position relative to the external tube 32.

To damp pivot of the internal tube 31 relative to the external tube 32, damping oil is provided between the internal tube 31 and the external tube 32.

The holders 123 extend from the base 12. Each of the holders 123 defines a slit 122 for receiving the ridge 311 or 321 of one of the slow pivot elements 30.

The holders 233 extend from the cover 20. Each of the holders 233 defines a slit 232 for receiving the ridge 311 or 321 of one of the slow pivot elements 30.

According to the first embodiment, two holders 233 are formed on a semi-sleeve 23 formed on the cover 20 and two auxilliary holders 243 are formed on a semi-sleeve 24 attached to the semi-sleeve 23. Each of the auxilliary holders 243 defines a slit 241 for receiving the ridge 311 or 321 of one of the slow pivot element 30. The semi-sleeve 24 can be engaged with the semi-sleeve 23 so that the auxilliary holders 243 abut the holders 233. The slit 241 defined in each of the auxilliary holders 243 matches the slit 232 defined in one of the holders 233 so as to make a slot for receiving the ridge 311 or 321 of one of the slow pivot elements 30.

Two nuts (not numbered) are formed on the semi-sleeve 23. Two apertures (not numbered) are defined in the semi-sleeve 24. Two bolts (not numbered) inserted through the apertures are engaged with the nuts, thus ensuring engagement of the semi-sleeve 24 with the semi-sleeve 23.

Figure 6:
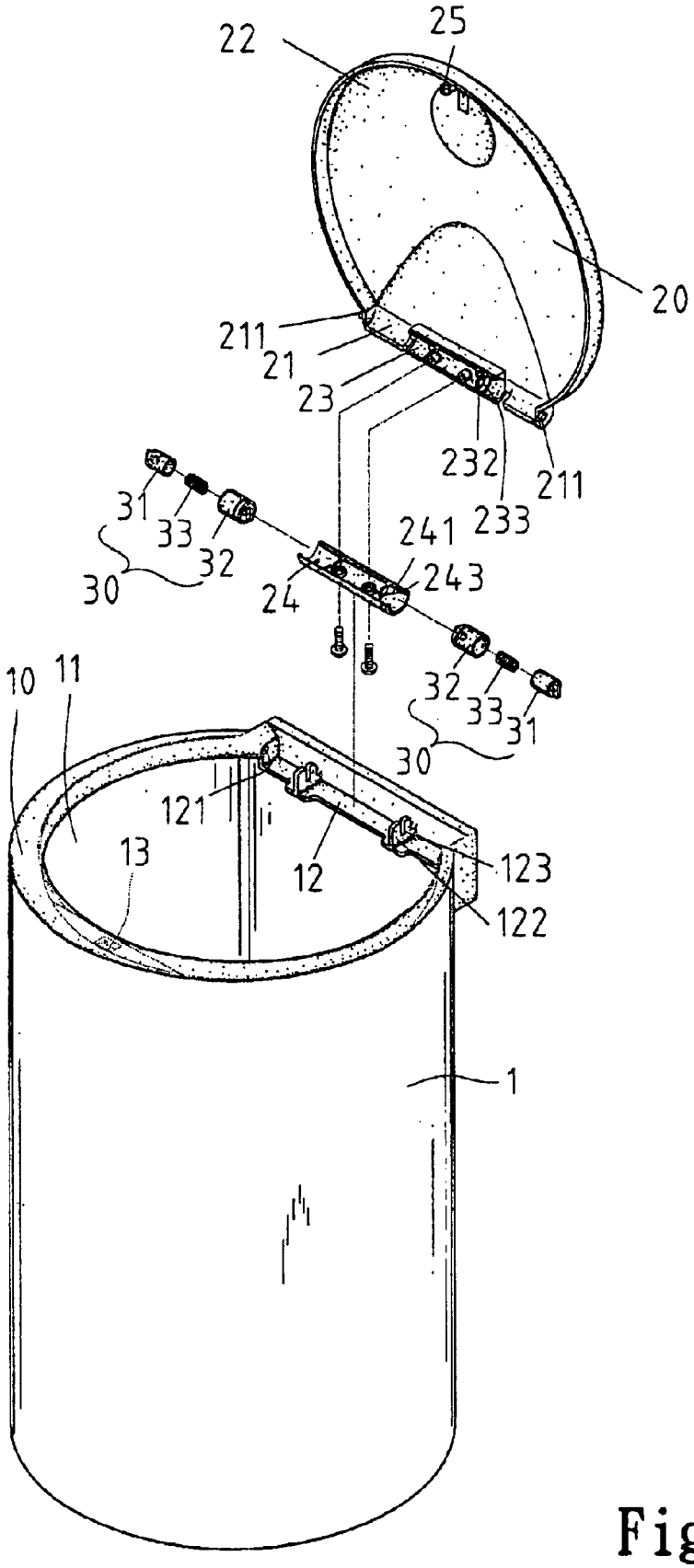
FIG. 6 is an exploded view of a hinge according to a second embodiment of the present invention.
Figure 7:
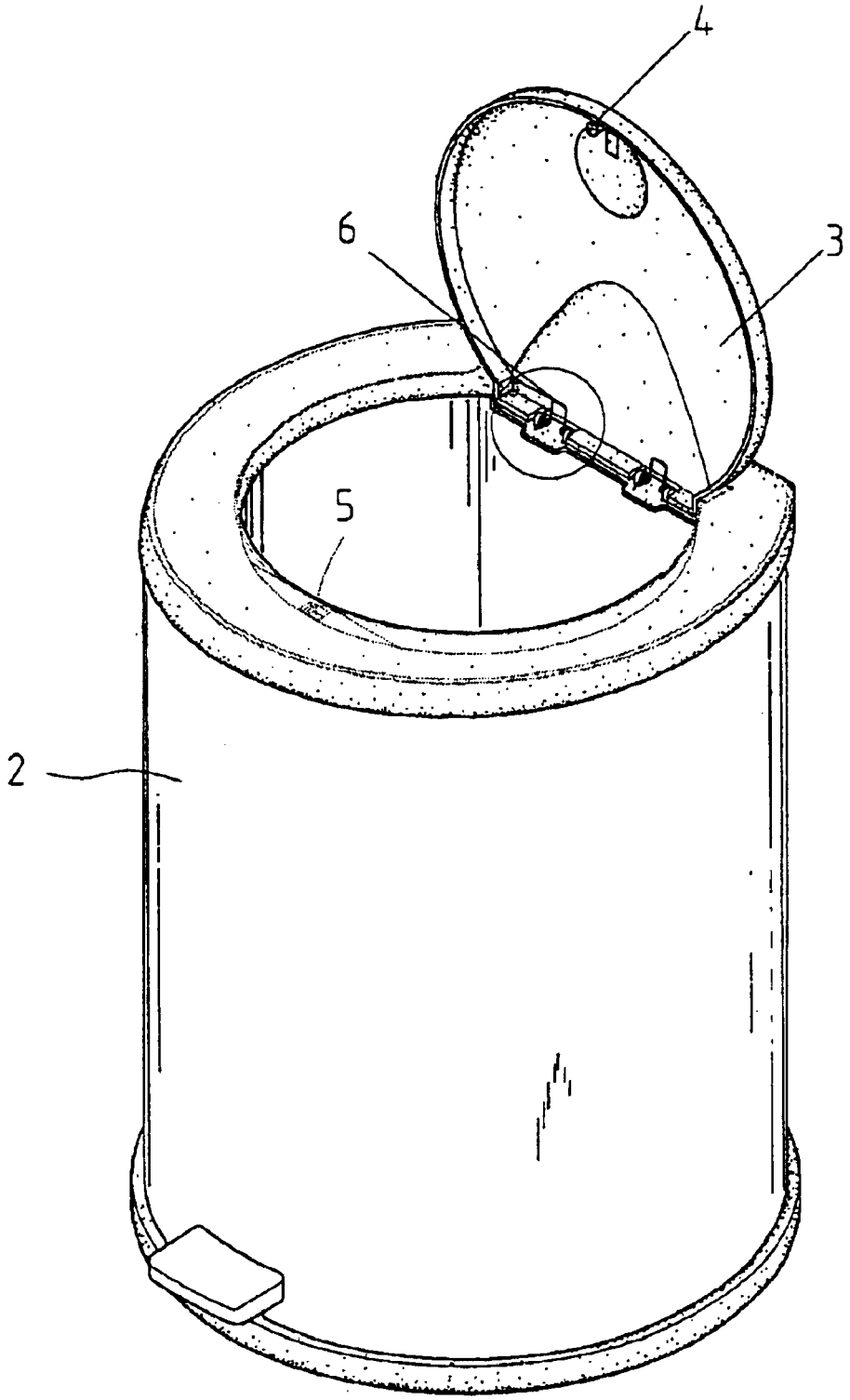
Fig. 7 PRIOR ART
FIG. 7 show a garbage bin on which a cover is pivotally mounted by means of a conventional hinge.
Figure 8:
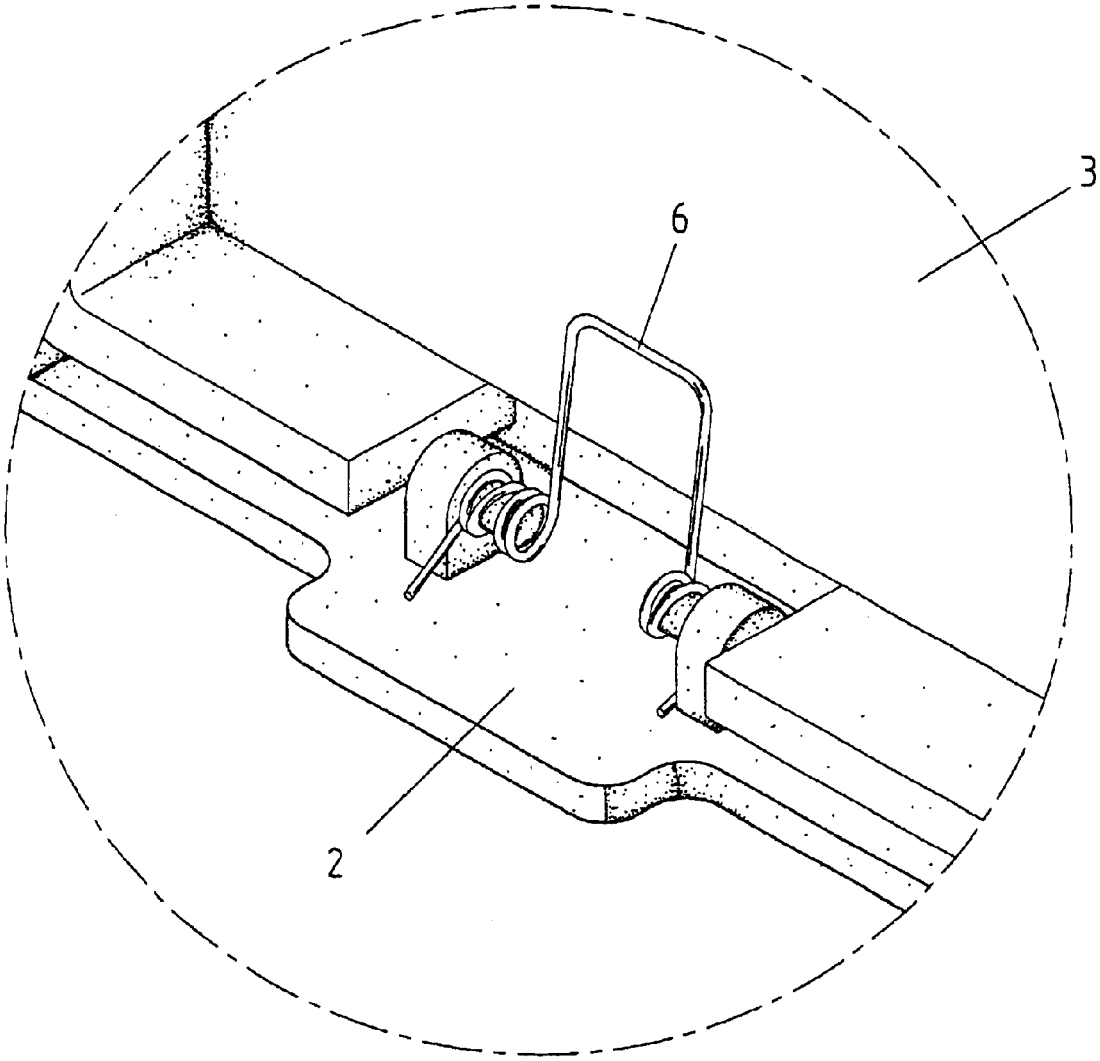
Fig. 8 PRIOR ART
FIG. 8 shows a portion of FIG. 7 in an enlarged scale.

FIG. 6 shows a garbage bin 1 on which a cover 20 is mounted according to a second embodiment of the present invention. The second embodiment is identical to the first embodiment except that the ring 10 is merged with the garbage bin 1.

The present invention has been described through detailed illustration of the preferred embodiment thereof. Those skilled in the art can derive many variations from the preferred embodiment without departing from the scope of the present invention. Therefore, the preferred embodiment shall not limit the scope of the present invention. The scope of the present invention can only be defined in the attached claims.

What is claimed is:

1. A cover assembly includes a ring mounted on a garbage bin, a cover mounted on the ring and a slow pivot device for slowly pivoting the cover relative to the ring from an open position to a closed position, with the slow pivot device including at least one slow pivot element, with the at least one slow pivot element including a first tube, a spring, and a first holder, with the first tube being rotatably mounted to one of the ring and the cover about an axis, with the spring connected between the first tube and the one of the ring and the cover, with rotation of the one of the ring and the cover relative to the first tube exerting torque on the spring to slow movement of the cover form the open position to the closed position, with the first tube having an end, with the first holder formed on the other of the ring and the cover, with the first holder having a slit, with the end of the first tube removably and replaceably received radially to the axis into the slit of the first holder, with the end being held in a nonrotational manner relative to the first holder by the slit of the first holder.

2. The cover assembly according to claim 1 wherein the slow pivot device includes at two slow pivot elements connected between the ring and the cover, with the two slow pivot elements being coaxial, opposite hand, and spaced axially from each other, with the first holder for each of the two slow pivot elements being axially exterior the two slow pivot elements.

3. The cover assembly according to claim 1 further comprising, in combination: an external tube on the one of the ring and cover, with the external tube at least partially enclosing the first tube and the spring, with the spring connected between the first tube and the external tube, with the external tube being stationary relative to the one of the ring and cover and rotatable about the first tube, so that rotation of the first tube relative to the external tube exerts torque on the spring.

4. The cover assembly according to claim 3 wherein the end is closed and includes a clip formed on an internal side of the end of the first tube for clipping an end of the spring.

5. The cover assembly according to claim 3 wherein the external tube has an end that is closed and includes a clip formed on an internal side of the end of the external tube for clipping another end of the spring.

6. The cover assembly according to claim 3 wherein the at least one slow pivot element includes damping oil provided between the first tube and the external tube in order to damp rotation of the first tube relative to the external tube.

7. The cover assembly according to claim 3 wherein the external tube is formed separately from the cover and the cover includes a second holder, with the first holder being formed on the ring for holding the end of the first tube of the at least one slow pivot element and the second holder formed on the cover for removably and replaceably holding the external tube stationary to the cover.

8. The cover assembly according to claim 7 with the external tube having an end, and the second holder formed on the cover having a slit, with the external tube having an end, and the second holder formed on the cover having a slit, with the end of the external tube removably and replaceably received radially to the axis into the slit of the second holder, with the end of the external tube being held in a nonrotational manner by the slit of the second holder.

9. The cover assembly according to claim 8 wherein the external tube includes a ridge formed at the end of the external tube, with the slit of the second holder removably and replaceably receiving the ridge if the external tube, with the ridge of the external tube slideably received into the slit radially to the axis, with the ridge of the external tube being noncircular to be nonrotationally held by the slit of the second holder.

10. The cover assembly according to claim 9 including a sleeve formed on the cover and defining the second holder, with the sleeve receiving the external tube, with the sleeve being cylindrical and coaxial to the at least one low pivot element, with the sleeve extending axially to at least partially enclose the at least one slow pivot element, with the ridge on the first tube of the at least one slow pivot element being accessible exterior the sleeve when the at least one slow pivot element is mounted to the cover.

11. The cover assembly according to claim 10 wherein the sleeve includes two semi-sleeves, with the two semi-sleeves being coaxial, semicylindrical, and engageable with each other, with a first semi-sleeve of the two semi-sleeves having an auxiliary holder with a slit, with the slit of the auxiliary holder cooperating with the slit of the second holder to constrain the ridge on the external tube.

12. The cover assembly according to claim 1 wherein the at least one slow pivot element includes a ridge formed at the end of the first tube, with the ridge being slideably received into the slit of the first holder radially to the axis, with the ridge being noncircular to be nonrotationally held by the slit of the first holder.

13. The cover assembly according to claim 1 wherein the cover includes a linear edge, with the linear edge being U shaped, with a spine of the linear edge being parallel to the axis of the at least one slow pivot element, with legs of the linear edge being perpendicular the spine and defining opposite ends, with the linear edge having two studs extending in opposite directions from the opposite ends of the linear edge of the cover, with the ring defining a linear section and a base, with the linear section being parallel to the axis of the at least one slow pivot element, with the base projecting horizontally and perpendicular to the linear section, with two walls projecting vertically form opposite ends of the base, with the two walls being perpendicular the linear section and adjacent the linear section, wherein the two walls define two apertures for receiving the two studs intermediate the two walls, thus pivotally mounting the cover on the ring, with the opposite ends of the linear edge of the cover being parallel and intermediate the two walls when the cover is mounted to the ring, with the slow pivot device being intermediate and spaced from the opposite ends of the cover when the cover is mounted to the ring.

14. The cover assembly according to claim 1 including a device for locking the cover to the ring .

15. The cover assembly according to claim 1 wherein the ring is merged with the garbage bin.

* * * * *